US005383511A

United States Patent [19]

Marasco

[11] Patent Number: 5,383,511

[45] Date of Patent: Jan. 24, 1995

[54] SUPPORT ROD ASSEMBLY FOR DRAPERY PANELS

[75] Inventor: Angelo M. Marasco, Madison, Wis.

[73] Assignee: Springs Window Fashions Division, Inc., Middleton, Wis.

[21] Appl. No.: 78,688

[22] Filed: Jun. 21, 1993

[51] Int. Cl.[6] ..... A47H 1/00

[52] U.S. Cl. ..... 160/330; 160/349.1

[58] Field of Search ..... 160/330, 349.1, 349.2, 160/333, 334, 125, 123, 124, 126, 109, 110, 112, 327

[56] References Cited

U.S. PATENT DOCUMENTS

| | | | |
|---|---|---|---|
| 1,219,774 | 3/1917 | Reeds | 160/110 |
| 1,600,807 | 9/1926 | Dover | 160/125 X |
| 2,016,741 | 10/1935 | Gossner | 160/330 |
| 2,109,346 | 2/1938 | Terzo | 160/334 |
| 2,132,067 | 10/1938 | Cleveland | 160/349.1 X |
| 2,175,501 | 10/1939 | Bergh | 160/334 X |
| 2,261,107 | 11/1941 | Nicolais | 160/125 X |
| 2,653,718 | 9/1953 | Woodward . | |
| 2,698,154 | 12/1954 | Woodward . | |
| 3,420,289 | 1/1969 | Bejarano . | |

*Primary Examiner*—David M. Purol
*Attorney, Agent, or Firm*—Vernon J. Pillote

[57] ABSTRACT

A support rod assembly for drapery panels in which an elongated horizontal rod is mounted by upper wall brackets on a wall for horizontally supporting an upper portion of a drapery panel and at least one vertical rod is mounted at its upper end on an upper bracket and mounted at its lower end on lower wall bracket for vertically supporting a portion of the drapery panel. The support rod assembly preferably includes front and rear vertical rods that are supported on the upper and lower bracket with the front vertical rod disposed forwardly of the rear vertical rod so that a drapery panel horizontally supported on the horizontal rod can be drawn around the front vertical rod and connected to the rear vertical rod. The wall brackets are preferably adjustable to vary the spacing of the horizontal and vertical rods relative to the wall or other supporting surface. Vertical rods can be provided on only one end of the horizontal rod in some installations and on both ends of the horizontal rod in other installations.

15 Claims, 3 Drawing Sheets

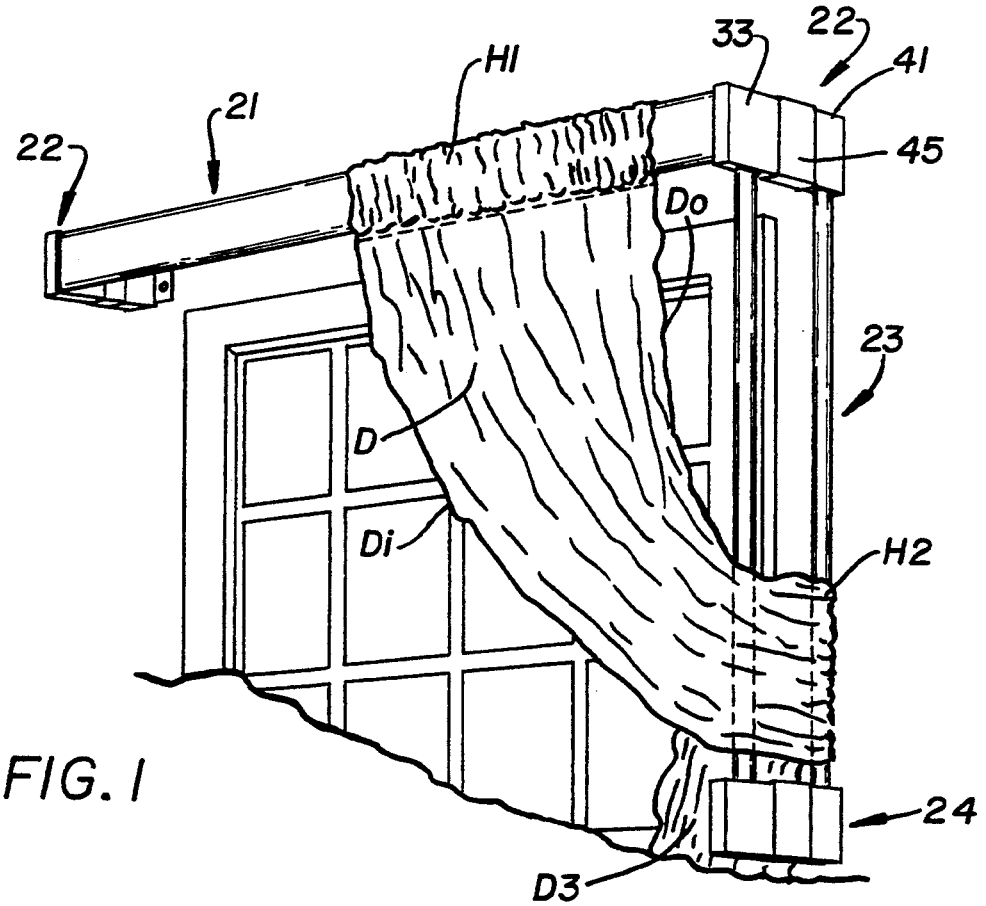
FIG. 1
FIG.2
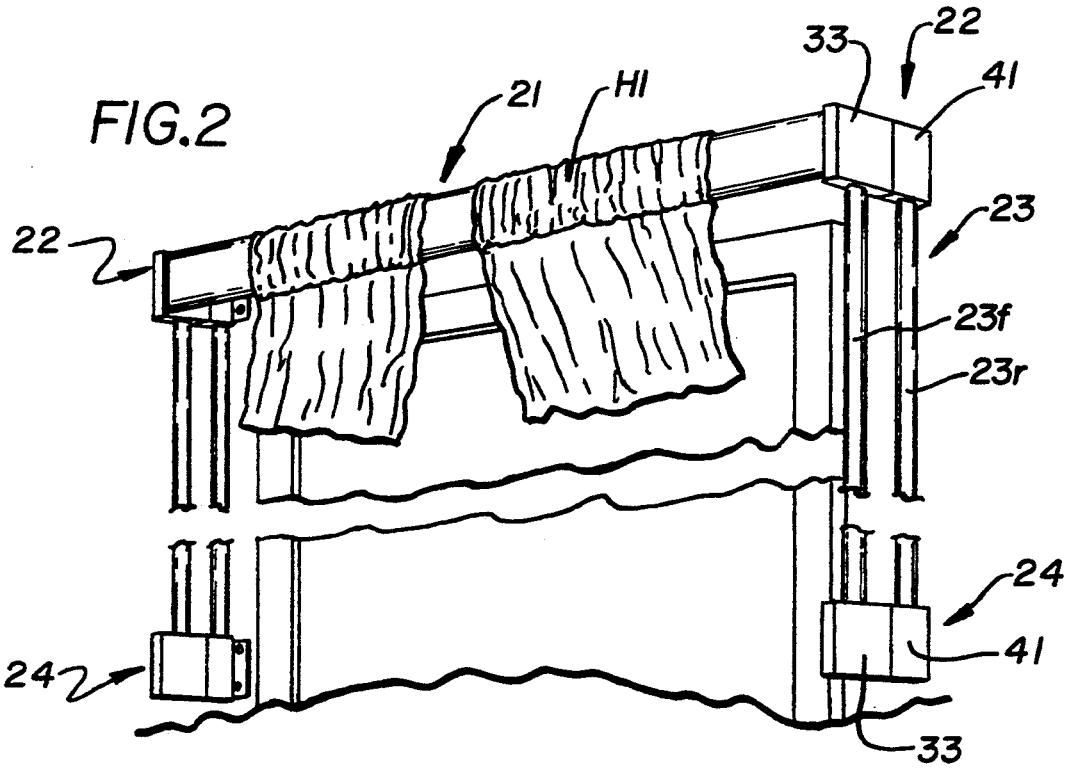

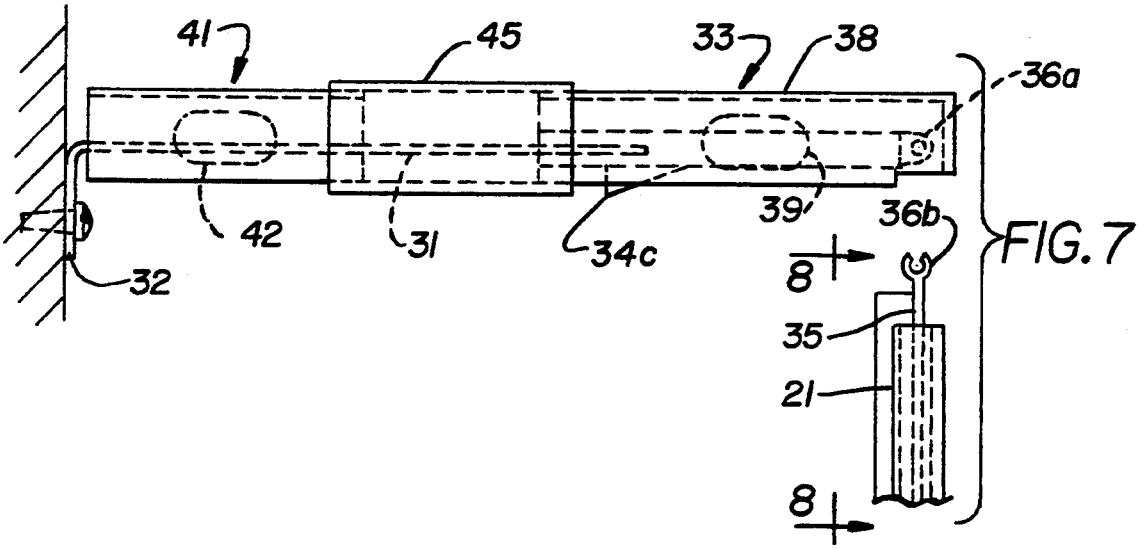
FIG. 7
FIG. 3
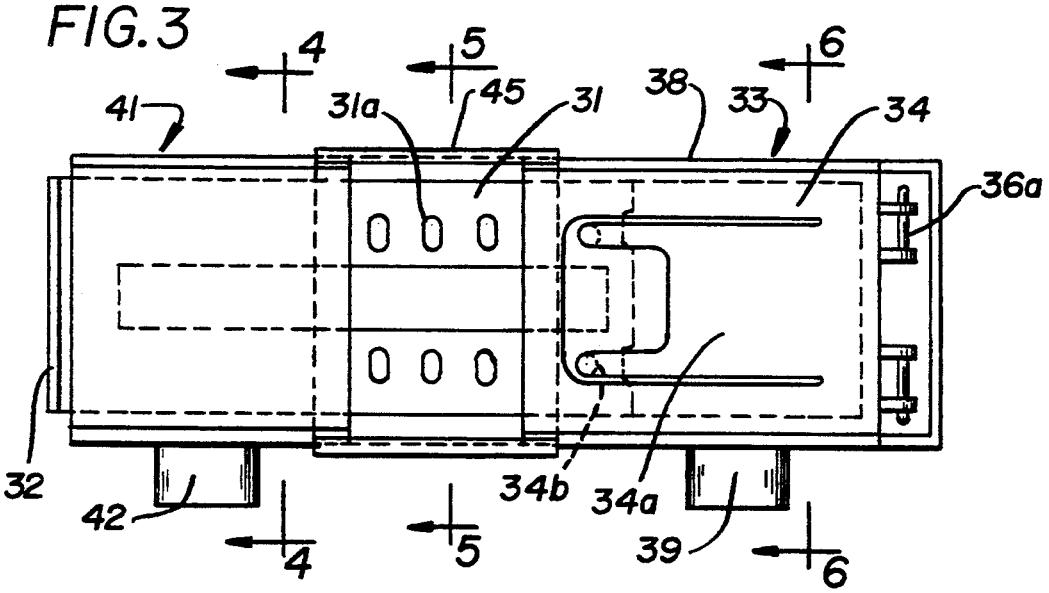
FIG. 4
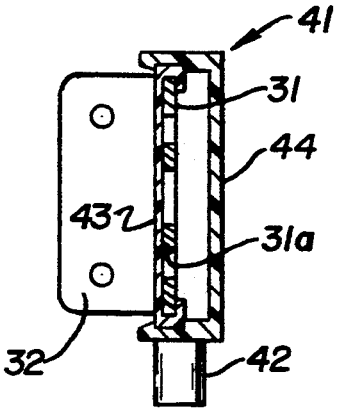
FIG. 5
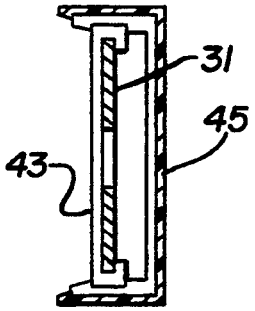
FIG. 6
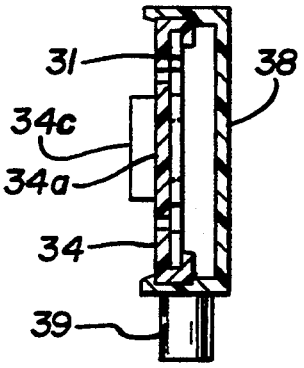

SUPPORT ROD ASSEMBLY FOR DRAPERY PANELS

In many curtain and drapery installations, a tie-back is looped around the drapery panel at a location below its upper end and anchored adjacent the side of a window opening so that the outer side edge of the drape hangs generally vertically adjacent the right edge of the window opening and the drape is drawn in folds or pleats toward the outer side edge of the panel. The ends of the tie-back loop are commonly attached directly to a wall or window casing. However, it has also been proposed as shown in U.S. Pat. Nos. 2,653,718 and 2,698,154, to provide brackets that extend downwardly from a valance or from a curtain rod with hooks adjacent their lower end for anchoring the tie-backs. A tie-back attached to the wall or window casing tends to crush the drapery pleats and U.S. Pat. No. 3,420,289 discloses a tie-back and return holder arranged to support the tie-back loop in a manner to minimize crushing of the drape folds.

SUMMARY OF THE INVENTION

It is the general object of the present invention to provide a support rod assembly for drapery panels which is adapted to support drapery panels at both the top and at the side of a window opening, and which enables mounting drapery panels in many configurations that cannot be achieved with conventional drapery rods and tie-backs.

Accordingly, the present invention provides a support rod assembly for drapery panels and the like in which an elongated horizontal rod means is mounted by upper wall bracket means on a wall for horizontally supporting an upper portion of a drapery panel or panels and at least one vertical rod means mounted at its upper end on an upper bracket means and mounted at its lower end on lower wall bracket means for vertically supporting a portion of the panel.

The support rod assembly preferably includes front and rear vertical rod means that are supported on the upper and lower bracket means with the front vertical rod means disposed forwardly of the rear vertical rod means so that a drapery panel horizontally supported on the horizontal rod means can be drawn around the front vertical rod means and connected to the rear vertical rod means. The wall bracket means are preferably adjustable to vary the spacing of the horizontal and vertical rod means relative to the wall or other supporting surface. Vertical rod means can be provided on only one end of the horizontal rod means in some installations and on both ends of the horizontal rod means in other installations.

BRIEF DESCRIPTION OF THE DRAWINGS

FIG. 1 is a fragmentary perspective view illustrating one embodiment of the invention;

FIG. 2 is a fragmentary perspective view illustrating a second embodiment;

FIG. 3 is a side view of one adjustable bracket means;

FIG. 4 is a transverse sectional view taken on the plane 4—4 of FIG. 3;

FIG. 5 is a transverse sectional view taken on the plane 5-5 of FIG. 3;

FIG. 6 is a transverse sectional view taken on the plane 6—6 of FIG. 3;

FIG. 7 is a top view of the bracket means of FIG. 3;

DETAILED DESCRIPTION

Figure 8:
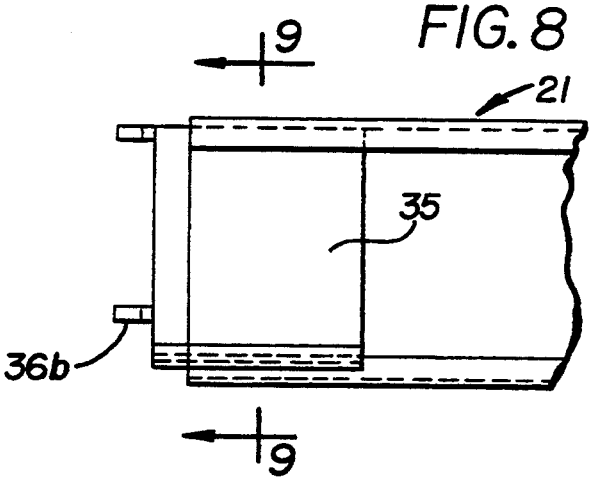
FIG. 8 is a fragmentary view of the horizontal rod means taken on the plane 8—8 of FIG. 7.

The present invention relates to a support rod assembly for drapery panels and the like. As used herein, the term "drapery" or "drapery panel" is intended to include not only heavy and medium weight fabrics commonly referred to as draperies but also light weight and sheer fabrics commonly referred to as curtains.

In general, the support rod assembly includes a horizontally disposed rod means 21 that is supported at its end in upper bracket means 22, and vertical rod means 23 supported at its upper end in one of the upper brackets 22 and at its lower end in a lower bracket means 24. The vertical rod means 23 can be provided at only one end of the horizontal rod means for some installations such as shown in FIG. 1, and at both ends of the horizontal rod means for other installations as shown in FIG. 2. The vertical rod means 23 preferably includes a front vertical rod **23*f* and a rear vertical rod 23*r* so that a drapery panel on the support rod assembly will hang in front of a window treatment such as a curtain or shade mounted over the window opening. In order to accommodate windows of different sizes, the horizontal rod means 21 preferably includes two or more telescopically adjustable sections. The vertical rod means 23 can also comprise telescopically adjustable sections to enable adjustment of the height of the support rod assembly. The upper bracket means 22 and lower bracket means 24 are also preferably adjustable horizontally to enable adjustment of the spacing of the horizontal rod 21 from the wall and also enable adjustment of the spacing of the front vertical rod 23*f*** from the wall.

The upper bracket means 22 have a similar construction except for modifications required to adaptage for use at left and right ends of the upper rod means 21. As best shown in FIGS. 3-7, the upper bracket means each include a stationary upper bracket arm 31, herein shown in the form of an elongate having a laterally extending flange or mounting portion 32 at a rear end adapted for mounting to an upright surface such as a wall, window frame or the like as by suitable fasteners. An adjustable front bracket member 33 is adjustably mounted on a forward end portion of the bracket arm 31. In the embodiment illustrated, the adjustable front bracket member 33 includes a mounting panel 34 disposed at the inner side of the arm 31 and having opposed channel portions which slidably support the front bracket member on the edges of the arm 31. Means are provided for adjustably locking the front bracket member 33 in adjusted position along the bracket arm and, as best shown in FIG. 3, the mounting panel 34 has a U-shaped slot molded therein and which defines laterally resilient tongue portion **34*a* having bosses 34*b* that are arranged to engage a selected opening in the rows of openings 31*a* in the arm 31. The tongue 34*a* is formed with a finger receiving tab 34*c* to enable pulling of the distal end of the tongue 34a laterally away from the arm 31** to disengage the bosses from the openings.

Figure 9:
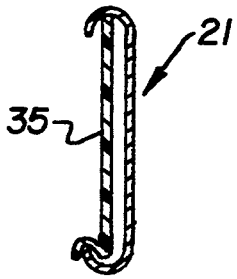
FIG. 9 is a transverse sectional view taken on the plane 9—9 of FIG. 8.

Means are provided on the forward end of the adjustable bracket member for supporting one end of the horizontal member 21. In the embodiment illustrated, the horizontal rod member has opposed U-shaped flanges along opposite edges as best shown in FIG. 9, and a rod support panel 35 is provided on the end of the adjustable bracket member and arranged to extend into the horizontal rod to support the latter. In order to enable the same adjustable bracket member to be used at either end of the rod, the rod support panel 35 is conveniently detachably mounted on the bracket member as by a hinge pin and hinge knuckle arrangement 36a, 36b of the type disclosed in U.S. Pat. No. 5,016,626 and best shown in FIGS. 3 and 7. The adjustable bracket member 33 also includes a front cover 38 mounted on the panel 34 and arranged to overly the outer side of the arm 31. A means 39 is provided on the cover 38 for supporting an end of a vertical rod. In the embodiment illustrated, the means 39 is in the form of a plug adapted to be received in a tubular vertical rod. It is deemed apparent that the means 39 could also be in the form of an opening or socket for receiving an end of a vertical rod, if desired.

The upper bracket member 22 also includes a rear bracket member 41 and means 42 thereon for supporting an end of a vertical rod member. As best shown in FIGS. 3 and 4, the rear bracket member 41 includes a rear panel 43 that overlies the inner side of the support arm 31 adjacent the mounting flange 32 and a cover member 44 that overlies the outer side of the support arm and has the means 42 thereon for supporting an end of a vertical rod. The rear bracket member need not be adjustable and any suitable means may be provided for retaining the rear bracket member in position on the arm 31.

The front bracket members 33 are adjustable between a retracted position as shown in FIG. 2 and an extended position as shown in FIG. 1 and in FIGS. 3 and 7. An intermediate cover member 45 is provided to cover the space between the front and rear bracket members when the front bracket member is adjusted to a position spaced from the rear bracket member. The lower bracket means 24 preferably has substantially the same construction as the upper bracket means 22, and each include a stationary bracket arm, an adjustable front bracket member 33 and a rear bracket member 41, with such modifications as may be required to mount the vertical rod means at the upper side of the lower bracket means.

Figure 11:
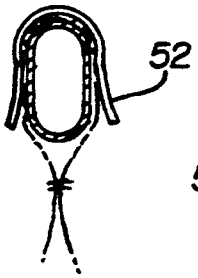
FIG. 11 is a transverse sectional view through a vertical rod and illustrating a clip for anchoring a drapery hem to the vertical rod.
Figure 10:
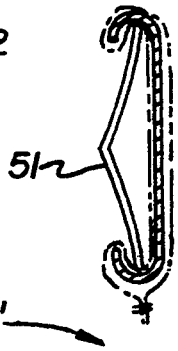
FIG. 10 is a transverse sectional view through the horizontal rod means and illustrating a clip for anchoring a drapery hem on the rod.

The horizontal rod means 21 is adapted to support an upper edge of a drapery panel indicated at D in FIG. 1 in a generally horizontal position and the vertical rod means 23 is adapted to support another portion of the drapery panel in a generally vertical position. Thus, the drapery panel can be arranged as shown in FIG. 1 in such a manner that both the inner and outer side edges of the drapery panels are curved. The upper edge of the drapery panel can be attached to the horizontal rod means 21 by suitable slides or carriers. However, the drapery panel is preferably formed with an upper hem pocket H1 which receives the horizontal rod means and a second hem pocket H2 that receives one of the vertical rod means. Preferably, the hem pockets H1 and H2 are spaced apart along one side edge Di of the drapery panel a distance greater than the spacing between the hem pockets H1 and H2 along the other side edge Do of the drapery panel. The drapery panel is installed so that the side edge Do is uppermost on the vertical rod. When vertical rod means are provided at each end of the horizontal rod, two upper panels designated D1 and D2 can be arranged to extend between the horizontal rod and their respective one of the vertical rod means as shown in FIG. 2 and additional panels (not shown) can be draped on the horizontal rod means at intermediate locations if desired. In addition, additional drapery panels such as indicated at D3 in FIG. 1 can be mounted on either the front or rear vertical rod means at either or both sides of the window opening, and arranged to hang downwardly thereon as shown in FIG. 1. The panels D3 can be part of a panel D or separate therefrom as desired. In order to hold the drapery panels in position along the horizontal rod 21, resilient clips such as shown at 51 in FIG. 10 are provided for clamping the fabric of hem pocket H1 against the inner side of the horizontal rod. Similarly, resilient U-shaped clamps 52 are provided for clamping the fabric to the outer side of the vertical rod as shown in FIG. 11.

Figure 12:
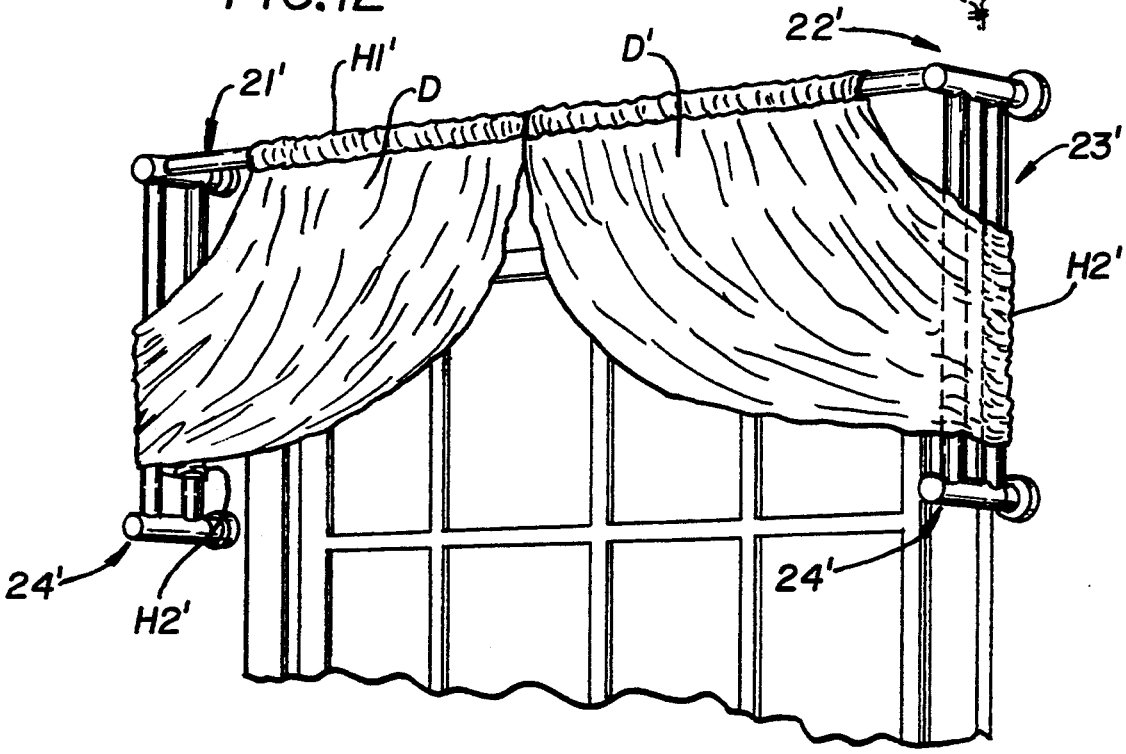
FIG. 12 is a fragmentary perspective view illustrating a third embodiment of the support rod assembly.

Another embodiment of the invention is illustrated in FIG. 12 and like numerals followed by the postscript ′ are used to designate corresponding parts. In this embodiment, the horizontal rod 21′ and the vertical rods 23′ are of tubular configuration and the upper and lower bracket means 22′ and 24′ are constructed and arranged to engage and support the ends of the tubes. As illustrated in FIG. 12, two drapery panels D′ have hems H1′ mounted on the horizontal rod means and hems H2′ mounted on a rear vertical rod means at opposite sides of the window opening.

The embodiments of the invention in which an exclusive property or privilege is claimed are defined as follows:

1. A support rod assembly for drapery panels and the like comprising: elongated horizontal rod means, first and second upper bracket means each having means at a rear end thereof adapted to be mounted on a wall and means adjacent a forward end thereof for supporting an end of said horizontal rod means, a first vertical rod means, means on the first upper bracket means for supporting an upper end of the vertical rod means, first lower bracket means having means at a rear end thereof adapted for mounting on a wall, means on the first lower bracket means for supporting a lower end of the first vertical rod means, a rear vertical rod means, means on said first upper bracket means for supporting an upper end of the rear vertical rod means at a location rearwardly of the first vertical rod means, and means on the first lower bracket means for supporting a lower end of the rear vertical rod means at a location rearwardly of the first vertical rod means.

2. A support rod assembly according to claim 1 wherein said upper bracket means and said lower bracket means are adjustable to change the spacing of the horizontal rod means from the rear ends of the upper bracket means and to change the spacing of said first vertical rod means from the rear ends of the first upper bracket means and first lower bracket means.

3. A support rod assembly according to claim 1 wherein said upper bracket means and said lower bracket means are adjustable to change the spacing of the horizontal rod means from the rear ends of the upper bracket means and to change the spacing between the first vertical rod means and the rear vertical rod means.

4. A support rod assembly according to claim 3 wherein the first and second upper bracket means each include a stationary upper bracket arm extending forwardly from the rear end of the upper bracket means and an adjustable upper bracket member mounted on the upper bracket arm, the means for supporting an end of the horizontal rod means being on each of the adjustable bracket members, the means for supporting an upper end of the first vertical rod means being on the adjustable upper bracket member of the first upper bracket means.

5. A support rod assembly according to claim 4 wherein the first lower bracket means includes a stationary lower bracket arm extending forwardly from the rear end of the lower bracket means and an adjustable lower bracket member mounted on the lower bracket arm, the means for supporting a lower end of the first vertical rod means being on the adjustable lower bracket member.

6. A support rod assembly according to claim 5 wherein the first upper bracket means has a rear upper bracket member mounted on the bracket arm, the means for supporting the upper end of the rear vertical rod means being the upper rear bracket member, the first lower bracket means having a lower rear bracket member mounted on the lower bracket arm, the means for supporting the lower end of the rear vertical rod means being on the lower rear bracket member.

7. A support rod assembly for drapery panels and the like comprising: elongated horizontal rod means, first and second upper bracket means each having means at a rear end thereof adapted to be mounted on a wall and means adjacent a forward end thereof for supporting an end of said horizontal rod means, a first vertical rod means, means on the first upper bracket means for supporting an upper end of the vertical rod means, first lower bracket means having means at a rear end thereof adapted for mounting on a wall, means on the first lower bracket means for supporting a lower end of the first vertical rod means, said upper bracket means and said lower bracket means being horizontally adjustable to change the horizontal spacing of the horizontal rod means and the first vertical rod means from the rear ends of the respective upper and lower bracket means.

8. A support rod assembly for drapery panels and the like comprising: elongated horizontal rod means, first and second upper bracket means each having means at a rear end thereof adapted to be mounted on a wall and means adjacent a forward end thereof for supporting an end of said horizontal rod means, first and second front vertical rod means, means on the first and second upper bracket means for supporting an upper end of the respective first and second front vertical rod means, first and second lower bracket means each having means at a rear end thereof adapted for mounting on a wall and means for supporting a lower end of the respective first and second front vertical rod means, each of the upper end lower bracket means being horizontally adjustable to change the horizontal spacing of the horizontal rod means and the first and second front vertical rod means from the rear ends of the respective upper and lower bracket means.

9. A support rod assembly for drapery panels and the like comprising: elongated horizontal rod means, first and second upper bracket means each having means at a rear end thereof adapted to be mounted on a wall and means adjacent a forward end thereof for supporting an end of said horizontal rod means, first and second front vertical rod means, means on the first and second upper bracket means for supporting an upper end of the respective first and second front vertical rod means, first and second lower bracket means each having means at a rear end thereof adapted for mounting on a wall and means for supporting a lower end of the respective first and second front vertical rod means, said first and second upper bracket means each having means adjacent the rear end thereof for supporting an upper end of a respective one of the first and second rear vertical rod means, said first and second lower bracket means each including means adjacent the rear end thereof for supporting a lower end of the respective first and second rear vertical rod means.

10. A support rod assembly according to claim 9 wherein each of said upper and lower bracket means are adjustable to change the spacing of the horizontal rod means and the first and second front vertical rod means from the rear ends of the bracket means.

11. A support rod assembly according to claim 10 wherein the first and second upper bracket means have respective first and second upper rear bracket members, the first and second lower bracket means having respective first and second lower rear bracket members.

12. A support rod assembly for drapery panels and the like comprising: elongated horizontal rod means, first and second upper bracket means each having means at a rear end thereof adapted to be mounted on a wall and means adjacent a forward end thereof for supporting an end of said horizontal rod means, at least a first vertical rod means, means on the first upper bracket means for supporting an upper end of the vertical rod means, first lower bracket means having means at a rear end thereof adapted for mounting on a wall, means on the first lower bracket means for supporting a lower end of the first vertical rod means, an elongated drapery panel having lengthwise extending edges, the panel having a first pocket extending crosswise of the panel for receiving said horizontal rod means and a second pocket for receiving the vertical rod means, the second pocket having one end spaced a first distance along one edge of the panel from one end of the first pocket and a second end spaced a substantially greater distance along a second edge of the panel from a second end of the first pocket.

13. A support rod assembly according to claim 12, including a drapery swag attached to the vertical rod means and extending downwardly therefrom.

14. A support rod assembly for drapery panels and the like comprising: elongated horizontal rod means, first and second upper bracket means each having means at a rear end thereof adapted to be mounted on a wall and means adjacent a forward end thereof for supporting an end of said horizontal rod means, at least a first vertical rod means, means on the first upper bracket means for supporting an upper end of the vertical rod means, first lower bracket means having means at a rear end thereof adapted for mounting on a wall, means on the first lower bracket means for supporting a lower end of the first vertical rod means, a rear vertical rod means, means on said first upper bracket means for supporting an upper end of the rear vertical rod means at a location rearwardly of the first vertical rod means, means on the first lower bracket means for supporting a lower end of the rear vertical rod means at a location rearwardly of the first vertical rod means, an elongated drapery panel having lengthwise extending edges, the panel having a first drapery pocket extending crosswise of the panel for receiving the horizontal rod means and a second pocket extending crosswise of the panel for receiving the rear vertical rod means, the second pocket having one end spaced a first distance along one edge of the first panel from one end of the first pocket, and a second end spaced a substantially greater distance along a second edge of the panel from a second end of the first pocket.

15. A support rod assembly according to claim 14 including a drapery swag attached to one of the vertical rod means and extending downwardly therefrom.

* * * * *